US005935470A

United States Patent [19]

Deo et al.

[11] Patent Number: 5,935,470

[45] Date of Patent: Aug. 10, 1999

[54] COMPOSITION HEATING ELEMENT FOR RAPID HEATING

[75] Inventors: Subhash R. Deo, Fayette County, Ala.; Herb Ray, Lowndes County, Miss.; Randall Markum, Lamar County, Ala.

[73] Assignee: Emerson Electric, St. Louis, Mo.

[21] Appl. No.: 08/908,755

[22] Filed: Aug. 8, 1997

[51] Int. Cl.[6] ..... H05B 3/68; H05B 3/44

[52] U.S. Cl. ..... 219/463.1; 219/544

[58] Field of Search ..... 219/448, 464, 219/468, 538, 539, 544, 552, 553; 252/512, 513, 518, 519

[56] References Cited

U.S. PATENT DOCUMENTS

| | | | |
|---|---|---|---|
| 3,068,340 | 12/1962 | Bremer et al. | 219/464 |
| 4,545,926 | 10/1985 | Fouts, Jr. et al. | 252/512 |
| 5,039,839 | 8/1991 | Masaka et al. | 219/544 |
| 5,206,483 | 4/1993 | Aota | 219/544 |
| 5,767,485 | 6/1998 | Kumada | 219/544 |

*Primary Examiner*—Teresa Walberg
*Assistant Examiner*—Sam Paik
*Attorney, Agent, or Firm*—Polster, Lieder, Woodruff & Lucchesi

[57] ABSTRACT

A heating element (10) for a cook top or the like has a predetermined heating profile by which the temperature of the heating element is rapidly increased from room temperature to a cooking temperature because of an initially high level of power dissipation in the element when a current is applied to the element. As a result of the high level of power dissipation, as the temperature of the element rises toward the cooking temperature, the power dissipation level falls to a predetermined level at which it subsequently remains. A first heating element material (12) has a first predetermined set of heating characteristics, and a second heating element material (14) has a second and different predetermined set of characteristics. When the materials are combined together to form the heating element, the element incorporates therein heating characteristics by which a desired heating profile is achieved; i.e., the rapid initial temperature increase and accompanying decrease in power dissipation.

27 Claims, 3 Drawing Sheets

COMPOSITION HEATING ELEMENT FOR RAPID HEATING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to heating elements of the type used in stove tops, clothes dryers, and other heating applications, and more particularly, to a composition heating element having a predetermined heating profile by which the temperature of the heating element rapidly increases from an ambient temperature to a predetermined operational temperature when an electrical current is first applied to the heating element.

In a conventional stove top heating element, when a temperature control unit for a particular element is turned on, electrical current is supplied to the heating element. As is well-known in the art, the temperature of the heating element then rises from room temperature to a desired cooking temperature as a result of the $I^2r$ losses in the heating element. Conventional heating elements take some time to reach their desired temperature, and the amount of this delay increases the time it takes to heat whatever is placed upon the heating element.

Modern consumers now want a range or stove that is significantly more responsive to turn-on to rapidly reach a set heating temperature selected by a user of the appliance. Users of other types of appliances employing other types of heating elements arc similarly wanting faster response time from their appliance when it is turned on. Typically, manufacturers attempt to have their heating elements reach a stabilized temperature on the order of three to five seconds from turn-on. Various attempts have been made to achieve this rapid response time; however, most of these have associated costs or consequences which are undesirable. For example, current approaches tend to shorten the useful life of the heating element. It would therefore be advantageous to provide a heating element having the advantages of rapid heating but without the cost penalties and/or shorter life cycle.

BRIEF SUMMARY OF THE INVENTION

Among the several objects of the present invention may be noted the provision of a heating element usable in a stove top, clothes dryer, and other heating applications where rapid heating is desirable or necessary;

the provision of such a heating element which is formable using a plurality of materials each having different temperature profiles, one or more of the heating element materials having a large change in resistivity over a range of temperatures, and other of the materials having a relatively constant resistivity over the same temperature range;

the provision of such a heating element which is formable into different sizes, cross-sections, and heating element shapes for a heating profile of the element to be determined in accordance with the relative amounts of materials used;

the provision of such a heating element having a resulting temperature profile which provides for a rapid increase in the heating element temperature from a room or ambient temperature, for example, to a desired operational temperature, this being achieved by an initial level of power dissipation in the heating element which is substantially higher than that of conventional heating elements;

the provision of such heating element in which the rapidly rising temperature of the heating element during its initial stage of operation results in a corresponding rapid decrease in power dissipation to a predetermined lower level at which it is subsequently maintained so that the heating element is essentially self-regulating;

the provision of such a heating element in which the heating element materials are formed such that one or more of the materials comprise a core layer and other of the materials comprise a jacket surrounding the core layer;

the provision of such a heating element in which the heating element is formed of a resistive alloy conductor or conductors and an additional resistive alloy conductor or conductors cold drawn or otherwise appropriately joined together such that the interface between the two materials is bonded together;

the provision of such a heating element employing a third material between a core material and an outer layer of material to control the resistivity of the heating element;

the provision of such a heating element to be formed, for example, of nickel and an iron-chromium-aluminum alloy materials, or two other materials having appropriate resistivities; and, the provision of such a heating element which is a cost effective solution for a rapidly heating yet long lived heating element useful in a variety of applications.

In accordance with the invention, generally stated, a heating element such as is used in a cook top or the like has a predetermined heating profile. The profile provides for a rapid increase in the heating element temperature from room temperature, for example, to a desired operational temperature. This rapid increase is achieved by the heating element having an initially high power dissipation level for a short duration after electrical current is supplied to the heating element. Further, the high level of power dissipation and the rapidly rising temperature act to decrease power dissipation in the heating element to a predetermined lower level which is maintained during the remainder of time power is applied to the heating element. A first material from which the heating element is manufactured has a first predetermined set of heating characteristics, and a second (or additional) heating element material has a second and different predetermined set thereof. In particular, the resistivity/temperature profiles for the respective materials are such that one material experiences a substantial resisitivity change over a range of temperatures; while the resistivity of the other material remains relatively constant. When the materials are formed together to produce the heating element, the heating element has incorporated therein heating characteristics by which the rapid temperature increase and decrease in power dissipation are achieved. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
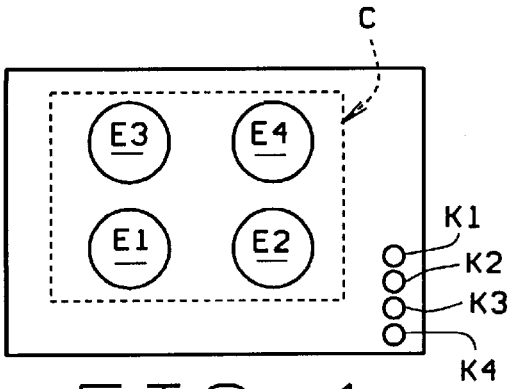
FIG. 1 PRIOR ART
FIG. 1 is a representation of a stove top cooking element.

Referring to the drawings, a cook top C is shown to include a plurality of heating units respectively designated E1–E4. Each of the units is separately controlled by a switch indicated K1–K4. Heating units for stove tops are well-known in the art, as is their operation. They are typically resistive type heating units made, for example, from an electrical wire arranged in a spiral pattern. The wire may be circular in cross-section, or have a flat, generally rectangular cross-section. The wire may also be placed in a tubular sleeve in which a powdered insulation material is flowed and then compacted by an appropriate working.

Figure 2:
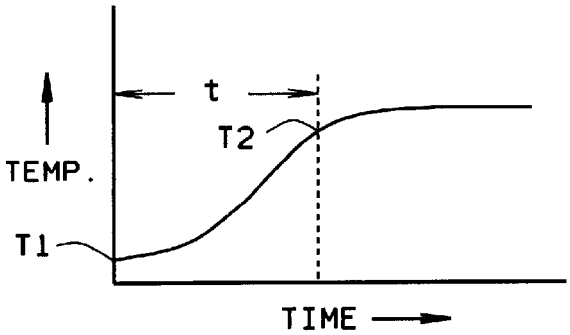
FIG. 2 PRIOR ART
FIG. 2 is a graph illustrating the time/temperature profile of a prior art heating element by which the temperature of the heating element increases from room temperature to a selected temperature at which food is to be cooked.

When a heating unit is off, the temperature of the resistive element in the unit is the ambient room temperature as indicated T1 in FIG. 2. When the heating unit is turned on, electrical current flows through the resistive element and the heat dissipation from the $I^2r$ losses now cause its temperature to increase from temperature T1 to a higher temperature T2. For a cooking unit C of FIG. 1, the temperature T2 is the temperature at which food may be cooked, water boiled, or something else heated on the cook top. If the heating unit were part of another appliance, a clothes dryer, for example, the temperature would be that at which clothes could be conveniently dried. A drawback with the current approach to heating is the time t required for the heating element to reach temperature T2. FIG. 2 is a representative heating profile for a heating element; and, while the interval t is not necessarily a lengthy period of time (8–12 seconds for a conventional heating element), it is now considered too long for acceptable performance. Rather, it is now a desired operational characteristic of heating elements that their temperature increase from T1 to T2 in only a small portion of the time t required by prior art heating elements, for example, 3–5 seconds.

Figure 3A:
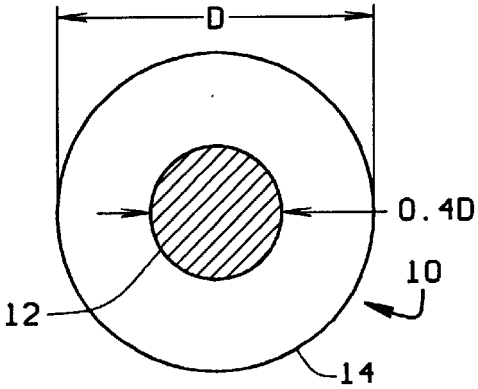
FIGS. 3A–3D illustrate a few of the representative cross-sections of a composite heating element of the present invention to produce a desired heating profile for the element.
Figure 4:
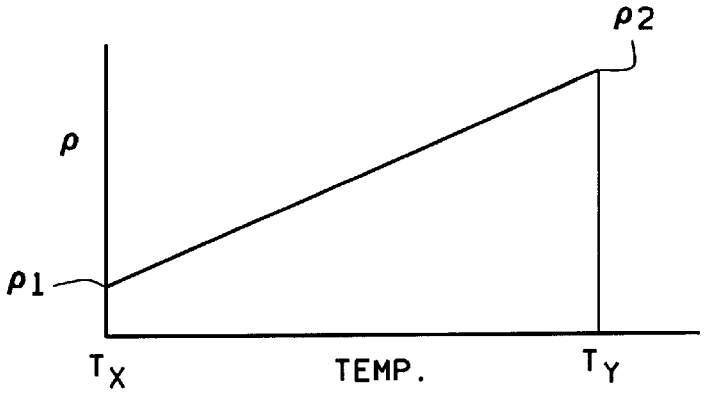
FIG. 4 is a graph illustrating the resistivity/temperature profile of a first material used to form the heating element.
Figure 5:
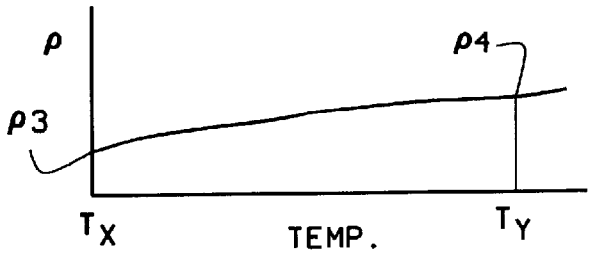
FIG. 5 is a graph illustrating the resistivity/temperature profile of a second material used to form the heating element.

In accordance with the present invention, a self-regulating, resistive heating element 10 (see FIGS. 3A–3D, and 8A, 8B) has a desired predetermined temperature profile and is composed of at least two separate heating element materials. As shown in FIG. 3A, a first of these heating element materials forms an inner or core layer 12 of the heating element. A second heating element material forming an outer layer 14 of the heating element. As shown in FIG. 4, the first material has a resistivity value ρ which ranges from a first value ρ1 to a second and substantially higher value ρ2 over a given temperature range Tx–Ty. The temperature range T1–T2 is encompassed in this temperature range. On the other hand, and as shown in FIG. 5, the second material has a relatively constant resistivity value over the same temperature range. That is, and as shown in the drawings, a resistivity value ρ3 at temperature Tx does vary significantly from the resistivity value ρ4 for the same material at the higher temperature value Ty.

Figure 6:
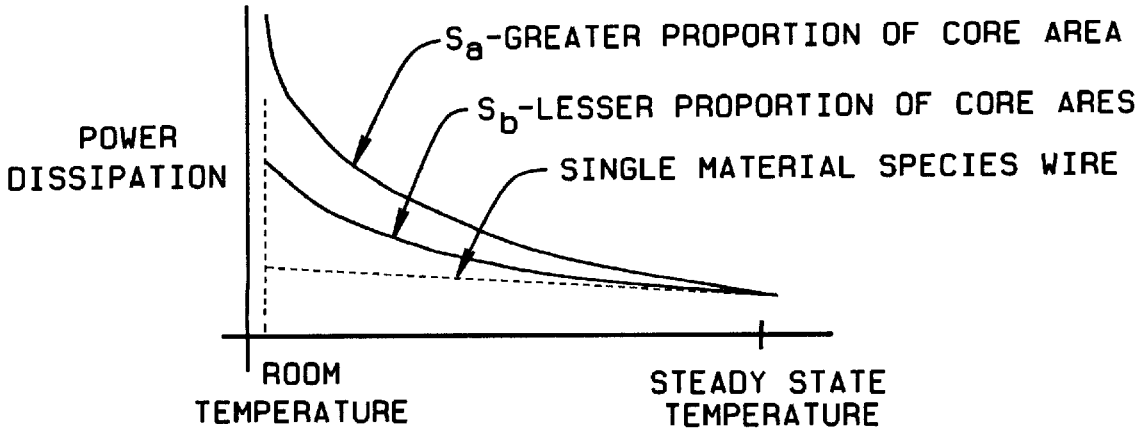
FIG. 6 is a power dissipation/temperature profile of a composite heating element of the invention.

As an example of the materials which may be used to form heating element 10, inner core layer 12 is formed using an electrically conductive material such as nickel. Such a material has a resistivity ranging from $\approx 2.8*10^{-6}$ Ω-in$^2$/in. at 20° C. (68° F.) to $\approx 19.7*10^{-6}$ Ω-in$^2$/in. at 1000° C. (1832° F.). The other heating element material is, for example, an iron-chromium-aluminum (Fe—Cr—Al) alloy such as manufactured by the Kanthal Corporation of Bethel, Conn., which has a resistivity ranging from $\approx 54.7*10^{-6}$ Ω-in$^2$/in. to $\approx 57.6*10^{-6}$ Ω-in$^2$/in. over the same temperature range. The result is heating element having a predetermined heating profile by which heating element 10 undergoes a rapid increase in temperature from an ambient room temperature, for example, to the higher cooking temperature. Such a heating profile is shown in FIG. 6. As shown in FIG. 6, the heat dissipation S (in watts/cm$^2$) of element 10, at temperature T1, is substantially higher than that of the element as it approaches temperature T2. It will be appreciated that other resistive materials, or resistive alloys, can be used for the respective first and second heating element materials depending upon the particular application for the heating element.

Figure 7:
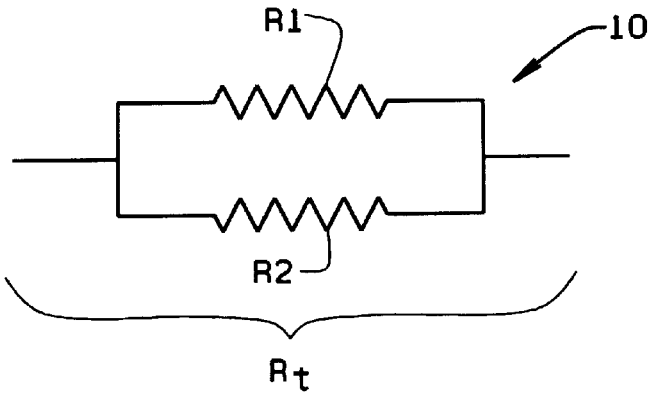
FIG. 7 is a schematic representation of the composite heating element.
Figure 8A:
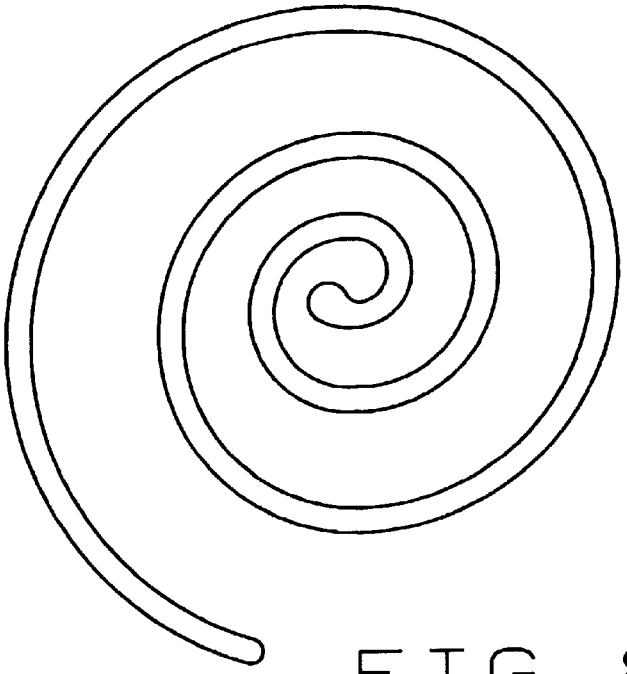
FIG. 8A illustrates a spiral shaped heating element made in accordance with the invention and used in cook tops or the like, and FIG. 8B an open coil heating element used in clothes dryers or the like and also made in accordance with the invention.
Figure 8B:
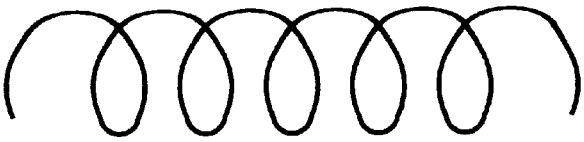

As noted, the first heating element material forms a core layer surrounded by the second material. The heating element is formed, for example, by cold drawing the materials so the outer surface of the inner layer of material mechanically bonds with the inner surface of the outer layer of material. Such mechanical bonds can be established by other means as well. The result is an element whose overall resistance corresponds to that of a pair of resistors connected in parallel. This is as shown in FIG. 7 where R1 represents the resistance of the first material forming the inner layer, and R2 the resistance of the other material forming the outer layer. The overall resistance Rt of the heating element is given by:

$$Rt=(R1*R2)/(R1+R2).$$

The voltage drop across the heating element is V, and the power dissipation P is given by:

$$P=V^2/Rt.$$

In accordance with the resistivity of the respective materials, as shown in FIGS. 4 and 5, the power or heat dissipation of the resultant composite material will be initially very high when current is applied to the heating element and as the temperature increases (so that the resistivity of the one element changes markedly with respect to that of the other element), the overall heat dissipation falls in accordance with the profile shown in FIG. 7. By way of example, if both resistances R1 and R2 are 100 Ω each at 20° C., and 110 v is applied to the heating element, in accordance with the foregoing equations, the overall resistance Rt of the heating element, at 20° C., is 50 Ω and the power dissipation is 242 w. At 1000° C., the resistance of the one heating element material will rise only by a small amount (to 105 Ω, for example), while that of the other will have increased substantially (to 700 Ω, for example). Now, the overall resistance Rt is 91 Ω, and the power dissipation is 132 w. As the temperature increases, the power dissipation reaches a predetermined level lower than that of the dissipation level at the initial stage of heating. The appreciably higher amount of power dissipation at the lower temperatures promotes the rapid temperature rise.

While the heating element 10 may have a number of shapes, in FIGS. 3A–3D, the heating element is shown to be circular in cross-section. In FIG. 3A, the first heating element material forms the inner core layer 12 and the second heating element material the outer annular layer 14. The heating profile of the heating element is determined by the diameter Dc of core 12 in relation to the overall diameter D of the heating element. It will be understood that the greater the diameter of the inner core to the overall diameter means that more of the material having a greater variation in resistivity over a given temperature range is used. A heating profile for this construction is indicated Sa in FIG. 6. If the diameter of the inner core to the the overall diameter is smaller, it means that less of the material having a greater variation in resistivity is used. A heating profile for this construction is indicated Sb in FIG. 6. Now, the initial heat dissipation is less. However, the steady state power dissipation can be designed to be the same as that of a single material resistive wire element. The factors which determine ratio between the core and overall diameters is how rapidly the heating element can reach its operating temperature and the effect of the resultant heat stress on the service life of the component, the costs of the materials, etc. In FIG. 3A, the diameter Dc is approximately 40% of the overall heating element diameter.

Figure 3B:
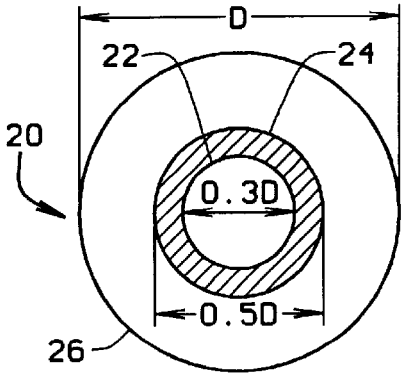

In FIG. 3B, a heating element 20 has an inner core layer 22, an intermediate annular layer 24, and an outer annular layer 26. For this construction, the inner core layer and outer annular layer are formed of the second metal alloy, and the intermediate annular layer the first metal alloy. Again the heating profile is a function of the relative amounts of heating element materials used. In FIG. 3B, the diameter of core 22 is 30% of the overall diameter of the heating element and the thickness of the intermediate annular layer 24 is 10% of the overall diameter. With respect to this construction, it will be understood that there could be more than two inner sections of the heating element and that for any number of layers, they would be alternating between the two alloys. Or, a third or other additional materials could be employed. Thus, in FIG. **3*b*, core 22, intermediate layer 24, and outer layer 26** could each be a different heating element material.

Figure 3C:
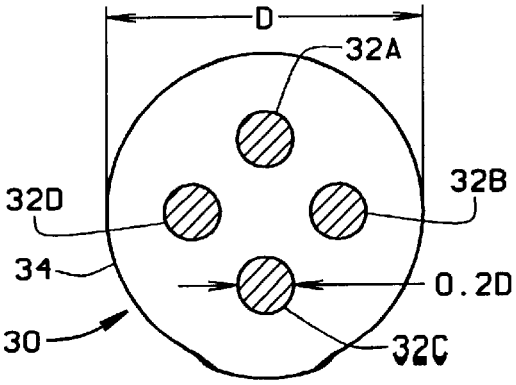
Figure 3D:
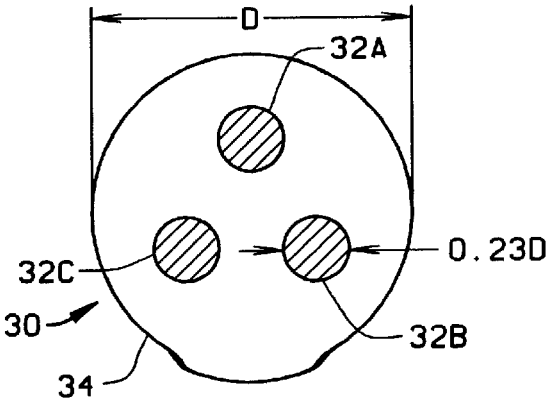

In FIGS. 3C and 3D, a heating element 30 has a plurality of core sections; sections 32A, 32B, 32C, and 32D in FIG. 3C, and 32A–32C in FIG. 3D. An outer layer 34 encompasses the respective cores in each heating element. The cores are each spaced from each other and are arranged in a geometric pattern. In FIG. 3C, each of the cores 32A–32D has a diameter of approximately 20% of the overall heating element diameter. In FIG. 3D, each element has a diameter which is 23% of the overall diameter. Again, each of the inner core sections could be of one heating element material, and the outer layer the other material. Or, each core could be of a different material. Further, relative sizes and pattern arrangements will vary as a function of the use of the heating element.

Heating elements made in accordance with the teachings of the present invention have been tested to determine their capability of rapid heating. An element was designed to dissipate 1700 w. at an elevated temperature when 240 v. was applied to it. The element dissipated about 3200 w. when power was first applied. The element glowed visibly in about 5 seconds, reaching a steady state temperature of approximately 1100° C. A corresponding element made of a single material resistive wire was found to take in excess of 10 seconds to visibly glow. The thermal equilibrium behavior of such resistive heating structures was also analyzed using computer simulation models. The thermal energy input was modeled to be spent in raising the temperature of the body incrementally to the steady state temperature when input energy equaled radiated energy. The behavior of the single species resistor element was analyzed vis-à-vis the two material species resistor element. The time required to reach a visibly radiant condition was calculated to be about 5 seconds for the two materials heating element and in excess of 10 seconds for the single material element.

What has been described is a heating element usable in a stove top for cooking food or in a variety of other heating applications where rapid heating from one temperature to another is desirable or required. The heating element is formed using two or more materials each having different temperature profiles with a first material having a large change in resistivity over a given temperature range, and a second material having a relatively constant resistivity over the same temperature range. The element is formable into a variety of sizes and shapes and has a resulting temperature profile providing for a rapid increase in the element temperature from the one temperature to the other, this being done by having a very high initial power dissipation in the heating element. This high power dissipation rapidly raises the temperature of the heating element; and as it does, power dissipation in the element falls to a predetermined lower level at which it is maintained the remainder of the time the heating element is powered. One of the materials forming the element comprises a core layer of the element and another of the materials an annular layer surrounding the core layer. The relative thicknesses of the core layer and annular layer are controllable to produce a desired temperature profile for a specific application. A variety of materials having the desired resistivities and appropriate cross-sectional areas can be used as the respective first and second materials, and the result is a heating element which provides a cost effective solution for rapid heating and also provides a long lived heating element useful in a variety of applications.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. A heating element having a predetermined heating profile for rapidly increasing the temperature of the heating element by providing a first level of power dissipation in the heating element for a short duration of time because of which the heating element temperature rapidly increases, the rapidly rising temperature of the heating element causing power dissipation of the heating element to decrease in a predetermined manner to a second and lower level which is thereafter maintained, the heating element comprising at least two heating element materials formed into an elongate resistive heating element having a predetermined shape and cross-sectional area, and formed into a predetermined pattern which provides a predetermined heat distribution for an object to be heated, one of the heating element materials having a first predetermined set of resistivity/temperature characteristics and the other of the materials having a second and different predetermined set of said characteristics, said heating element materials, when combined together to form said heating element, producing said predetermined heating profile, said first heating element material forming an inner core layer of said heating element, and said second heating material forming an outer layer thereof encompassing said inner layer throughout the length of the heating element.

2. The heating element of claim 1 having a plurality of concentrically formed layers with alternating layers being comprised of said first and second heating element materials.

3. The heating element of claim 1 formed of a plurality of spaced lengths of said first heating element material all of which are encompassed by said second heating element material.

4. The heating element of claim 3 wherein at least one of said spaced lengths is formed of a third heating element material having a third set of characteristics different from those of said first and second heating element materials.

5. The heating element of claim 1 wherein the cross-sectional areas of the core layer and annular layer are variable in a selective manner to achieve a predetermined heating profile desired for a particular application of the heating element.

6. The heating element of claim 1 which is a cold drawn heating element in which abutting surfaces of said heating element materials are bonded together.

7. The heating element of claim 1 wherein one of said heating element materials has a large change in resistivity over a given temperature range and another of said heating element materials has a substantially constant resistivity over the same temperature range.

8. The heating element of claim 1 which is a spiral heating element used on cook tops and the like.

9. The heating element of claim 1 which is an open coil heating element used in clothes dryers and the like.

10. A self-regulating resistive heating element providing a predetermined heat distribution for an object to be heated comprising:

at least one heating element material forming an inner, core layer of said heating element; and, at least one heating element material forming an annular outer layer thereof encompassing said inner layer, said material forming said inner layer having a resistivity value which ranges from a first value to a second and substantially higher value over a given temperature range, and said material forming said outer layer having a substantially constant resistivity value over the same temperature range, a resulting heating profile of said heating element facilitating a rapid increase in temperature from one temperature to a second and higher temperature due to power dissipation of the heating element at the one temperature, the heating profile being such that as the heating element temperature rapidly rises to the second temperature, the power dissipation of the heating element falls to a lower level at which it is subsequently maintained.

11. The heating element of claim 10 wherein one of said heating element materials is a first resistive alloy conductor material and the other said heating element material is a second resistive alloy conductor material, said first resistive alloy conductor material forming said inner layer of said heating element and said second resistive alloy conductor material said outer layer thereof, said second resistive alloy conductor material having a substantially constant resistivity value over a range of temperatures ranging from an ambient room temperature to a predetermined elevated temperature at which said object is to be heated and said first resistive alloy conductor material having a resistivity value which ranges from a first value to a second and substantially higher value over the same temperature range, said first and second resistive alloy conductor materials forming respective resistors connected in parallel for the temperature of said heating element to rapidly rise to said predetermined elevated temperature when an electric current is applied to said heating element.

12. A heating element having a predetermined heating profile by which the temperature of the heating element rapidly changes from room temperature to an elevated temperature, the heating element comprising a first heating element material forming a core of the heating element and whose resistivity changes over a given temperature range, and a second heating element material encompassing said core and having a substantially constant resistivity over the same temperature range, cross-sectional areas of said first and second heating element materials, when combined together in a predetermined manner to form the heating element establishing the heating characteristics of the heating element in conformance with the predetermined heating profile.

13. A method of forming a resistive heating element comprising:

forming at least one inner core layer of the heating element from a first heating element material having a first predetermined set of resistivity/temperature characteristics; and, forming an annular outer layer of the heating element from a second heating element material having a second and different set of resistivity/temperature characteristics, said outer layer encompassing said inner layer and said first and second heating element materials being joined together to form a heating element having a desired heating profile by which the temperature of the heating element is rapidly increased from a first to a second and higher temperature by providing a first level of power dissipation in the heating element when electric current is first supplied thereto, the rapidly rising temperature of the heating element causing a decrease in the power dissipation of the heating element to a second and lower level which is thereafter maintained.

14. The method of claim 13 further including forming said resistive heating element into a predetermined pattern shape to provide a predetermined heat distribution for an object to be heated.

15. The method of claim 14 further including forming the resistive heating element into a spiral wound heating element.

16. The method of claim 14 further including forming the resistive heating element into an open coil heating element.

17. The method of claim 13 wherein said inner layer of material is encompassed by said outer layer throughout the length of the heating element.

18. The method of claim 17 further including varying cross-sectional areas of the respective inner and outer layers in a predetermined manner to achieve a predetermined heating profile desired for a particular application of said heating element.

19. The method of claim 13 further including forming said heating element by cold drawing said first and second heating element materials for adjacent surfaces of said heating element materials to bond together.

20. The method of claim 13 further including forming said heating element from one heating element material having a change in resistivity over a given temperature range and from a second heating element material having a substantially constant resistivity over the same temperature range.

21. The method claim 20 wherein said first heating element material has said resistivity change, and said second heating element material has said substantially constant resistivity.

22. A method of making a self-regulating resistive heating element which provides a predetermined heat distribution for an object to be heated comprising:

forming an inner layer of the heating element from a first metal alloy having a first predetermined set of heating characteristics; and, forming an outer layer of the heating element from a second metal alloy having a second and different set of heating characteristics, said outer layer encompassing said inner layer of said heating element, the said first metal alloy having a resistivity value which varies significantly over a given temperature range, and said metal alloy having a substantially constant resistivity value over the same temperature range, the resulting heating profile of said heating element facilitating a rapid increase in temperature from one temperature to a second and higher temperature due to the power dissipation of the heating element at the one temperature, the heating profile being such that as the heating element temperature rapidly rises to the second temperature, the power dissipation of the heating element falls to a lower level at which it is subsequently maintained.

23. The method of claim 22 wherein said first and second metal alloys are arranged in alternating annular rings the thicknesses of which determine the heating profile of the heating element.

24. The method of claim 22 wherein said first metal alloy comprises a plurality of spaced cores extending the length of the heating element and said second metal alloy comprises an outer layer encompassing said cores, the thicknesses of said cores and said outer layer determining the heating profile of the heating element.

25. The method of claim 22 further including forming said heating element using a third metal alloy having heating characteristics similar to those of one of the other two metal alloys.

26. In a cooking unit for cooking food and the like, a heating element whose temperature rapidly increases from an ambient room temperature to a temperature for cooking food comprising:

a first metal alloy forming an inner, core layer of said heating element;

a second metal alloy forming an outer layer encompassing said inner layer, said first alloy having a resistivity value which ranges from a first value to a second and substantially higher value over a given temperature range, and said second alloy having a substantially constant resistivity value over the same temperature range, the resulting heating profile of said heating element facilitating a rapid increase in temperature from said ambient room temperature to a food cooking temperature due to the power dissipation of the heating element when electric current is first supplied thereto, the heating profile for said heating element being such that as the heating element temperature rapidly rises to the food cooking temperature, the power dissipation of the heating element falls to a lower level at which it is subsequently maintained.

27. The heating element of claim 26 wherein said heating element is formed in a spiral, wound configuration.

* * * * *